US009058773B2

(12) United States Patent
Park

(10) Patent No.: US 9,058,773 B2
(45) Date of Patent: Jun. 16, 2015

(54) DC-DC CONVERTER, DISPLAY DEVICE INCLUDING THE SAME AND METHOD OF CONTROLLING A DRIVING VOLTAGE

(75) Inventor: Sung-Cheon Park, Yongin-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 478 days.

(21) Appl. No.: 13/368,478

(22) Filed: Feb. 8, 2012

(65) Prior Publication Data

US 2012/0293562 A1 Nov. 22, 2012

(30) Foreign Application Priority Data

May 18, 2011 (KR) ..... 10-2011-0046694

(51) Int. Cl.
*G09G 5/00* (2006.01)
*G09G 3/32* (2006.01)

(52) U.S. Cl.
CPC ..... *G09G 3/3233* (2013.01); *G09G 2330/02* (2013.01); *G09G 2330/026* (2013.01); *G09G 2330/04* (2013.01); *G09G 2330/12* (2013.01)

(58) Field of Classification Search
CPC ... G09G 2330/00; G09G 3/00; G09G 3/3233; G09G 2330/02; G09G 2330/04; G09G 2330/12; G09G 2330/026
See application file for complete search history.

(56) References Cited

U.S. PATENT DOCUMENTS 5,224,010 A 6/1993 Tran et al.
5,515,390 A 5/1996 Benton
7,443,641 B2 10/2008 Suzuki
7,675,245 B2 3/2010 Szczeszynski et al.
8,487,924 B2 * 7/2013 Jin et al. ..... 345/212
8,817,429 B2 8/2014 Park
2003/0122530 A1 7/2003 Hikita
2005/0007316 A1 1/2005 Akimoto et al.
2007/0035533 A1 2/2007 Kim
2008/0111810 A1 5/2008 Park
2008/0143655 A1 6/2008 Ko
2008/0246702 A1 10/2008 Lee et al.
2008/0246749 A1 * 10/2008 Lee et al. ..... 345/207
2011/0025667 A1 2/2011 Chung (Continued)

FOREIGN PATENT DOCUMENTS

CN 101231818 A 7/2008
CN 101675465 A 3/2010

(Continued)

OTHER PUBLICATIONS

Quad Voltage Up and Down Sequencer and Monitor with Programmable Timing AMD1186; Analog Devices; 2008-2009 (Jun. 2009); pp. 1-28; Analog Devices; U.S.A.

(Continued)

*Primary Examiner* — Lixi C Simpson
(74) *Attorney, Agent, or Firm* — Lee & Morse, P.C.

(57) ABSTRACT

A DC-DC converter may include a voltage conversion unit and a short detection unit. The voltage conversion unit may be configured to generate a DC voltage for driving a display panel based on an input voltage. The short detection unit may be configured to generate a driving voltage based on the DC voltage and to output the driving voltage through a power line. The short detection unit may be configured to perform a short detection to detect whether the display panel is shorted based on a short detection reference that is adjusted according to an operation mode of the display panel.

21 Claims, 13 Drawing Sheets

(56) References Cited

U.S. PATENT DOCUMENTS

| | | | | |
|---|---|---|---|---|
| 2011/0273422 | A1* | 11/2011 | Park | 345/211 |
| 2012/0050249 | A1 | 3/2012 | Jin et al. | |
| 2012/0182328 | A1* | 7/2012 | Yoon et al. | 345/690 |

FOREIGN PATENT DOCUMENTS

| | | | |
|---|---|---|---|
| EP | 1 783 536 | A1 | 5/2007 |
| EP | 1978506 | A2 | 10/2008 |
| JP | H 6-348220 | A | 12/1994 |
| JP | 2000-214423 | A | 8/2000 |
| JP | 2003-173211 | A | 6/2003 |
| JP | 2003-229490 | A | 8/2003 |
| JP | 2005-020833 | A | 1/2005 |
| JP | 2005-098785 | A | 4/2005 |
| JP | 2005-218190 | A | 8/2005 |
| JP | 2006-042079 | A | 2/2006 |
| JP | 2007-089239 | A | 4/2007 |
| JP | 2007-222000 | A | 8/2007 |
| JP | 2009-237200 | A | 10/2009 |
| JP | 2010-011566 | A | 1/2010 |
| JP | 2010-026393 | A | 2/2010 |
| KR | 10 2000-0060439 | A | 10/2000 |
| KR | 10-2001-0009064 | A | 2/2001 |
| KR | 10 2001-0019944 | A | 3/2001 |
| KR | 10 2002-0034607 | A | 5/2002 |
| KR | 10 2004-0058780 | A | 7/2004 |
| KR | 10 2005-0020253 | A | 3/2005 |
| KR | 10-2005-0051074 | A | 6/2005 |
| KR | 10-2007-0032926 | A | 3/2007 |
| KR | 10-2008-0019197 | A | 3/2008 |
| KR | 10-2009-0105227 | A | 10/2009 |
| KR | 10-2010-0056010 | A | 5/2010 |
| KR | 10-0956162 | B1 | 5/2010 |
| KR | 10 2011-0012310 | A | 2/2011 |

OTHER PUBLICATIONS

Chinese Office action dated Aug. 5, 2014 for CN 201110166661.8 (Park).

European Search Report in EP 11176855.2-1228, dated Dec. 6, 2011 (Park).

USPTO Action mailed Aug. 19, 2014, in U.S. Appl. No. 13/197,054, wherein claims were provisionally rejected on the ground of nonstatutory double patenting over claims of the captioned application.

* cited by examiner

DC-DC CONVERTER, DISPLAY DEVICE INCLUDING THE SAME AND METHOD OF CONTROLLING A DRIVING VOLTAGE

CROSS-REFERENCE TO RELATED APPLICATION

This application claims priority under 35 USC §119 to Korean Patent Application No. 2011-0046694, filed on May 18, 2011 in the Korean Intellectual Property Office (KIPO), the contents of which are herein incorporated by reference in their entirety.

BACKGROUND

1. Technical Field

Example embodiments relate to detecting a short current.

2. Description of the Related Art

Generally, a display device includes a display panel having a plurality of pixels arranged in a matrix form. Each of the plurality of pixels operates in response to a driving voltage.

SUMMARY

Embodiments may be directed to a display device including a DC-DC converter.

According to example embodiments, a DC-DC converter may include a voltage conversion unit and a short detection unit. The voltage conversion unit may generate a DC voltage for driving a display panel based on an input voltage. The short detection unit may be configured to generate a driving voltage based on the DC voltage and to output the driving voltage through a power line. The short detection unit may be configured to perform a short detection to detect whether the display panel is shorted based on a short detection reference that is adjusted according to an operation mode of the display panel.

In example embodiments, the short detection unit may include a voltage output block to stabilize the DC voltage to generate the driving voltage, and a short detection block may be configured to generate a sensing current that is proportional to a current flowing through the power line, may generate a sensing voltage based on the sensing current and a detection control signal related to the operation mode, and to determine, based on a level of the sensing voltage, whether a short current flows through the power line.

In example embodiments, the voltage output block may include an input block configured to transmit an output voltage of the voltage conversion unit to the power line based on a control voltage, a voltage division block configured to divide the driving voltage by a division ratio, the voltage division block being configured to output a divided driving voltage, and an error amplification block may be configured to generate the control voltage by comparing a level of the divided driving voltage with a level of an amp reference voltage, the error amplification block applying the control voltage to the input block.

In example embodiments, the short detection unit may include a current sensing block configured to generate the sensing current proportional to the current flowing through the power line, a level selection block configured to generate the sensing voltage based on the detection control signal, the sensing voltage corresponding to the sensing current and having different detection sensitivities according to the operation mode, and a comparison block configured to generate a short detection signal by comparing the level of the sensing voltage with a level of a reference voltage.

In example embodiments, the current sensing block may include a sensing transistor that forms a current mirror with a pass transistor of the voltage output block, the voltage output block performing a linear low-dropout voltage regulation using the pass transistor.

The sensing current may flow through the sensing transistor and the level selection block, the sensing current being proportional to the current flowing through the power line coupled to the pass transistor.

In example embodiments, the level selection block may include a plurality of switches to be selectively turned on in response to a selection signal, and a plurality of resistors respectively coupled to the plurality of switches in series.

When the switches are turned on, the sensing voltage may be generated by the sensing current flowing through at least one of the plurality of resistors coupled to the switches.

In example embodiments, the level selection block may have a controlled impedance, the controlled impedance being controlled by the selection signal.

The level selection block may be configured to generate the sensing voltage based on the controlled impedance.

In example embodiments, the short detection unit may include at least one low-dropout regulator configured to output the driving voltage for driving the display panel to the power line.

In example embodiments, the operation mode of the display panel may include a start-up mode and a normal operation mode.

The short detection reference may be adjusted to a first value in the start-up mode and may be adjusted to a second value lower than the first value in the normal operation mode.

The short detection unit may perform the short detection based on the short detection reference of the first value when the display panel is in the start-up mode and may perform the short detection based on the short detection reference of the second value when the display panel is in the normal operation mode.

In example embodiments, black data may be applied to the display panel as display data in the start-up mode and valid image data may be applied to the display panel as display data in the normal operation mode.

In example embodiments, the short detection unit may generate a shut-down control signal based on a result of the short detection, and the voltage conversion unit may be shut down based on the shut-down control signal.

In example embodiments, the short detection reference may have different detection thresholds according to the operation mode of the display panel.

In example embodiments, the short detection unit may perform the short detection based on the short detection reference when a detection enable signal is activated.

In example embodiments, the short detection unit may perform the short detection by comparing a level of a sensing voltage with a level of a reference voltage, the level of the sensing voltage may be determined based on the short detection reference and a magnitude of a short current flowing through the power line.

In example embodiments, a value of the reference voltage may be set by an external control signal, or programmed as a predetermined value by cutting a fuse.

In example embodiments, the display panel may include an organic light emitting display panel.

The driving voltage generated by the short detection unit may include a positive driving voltage and a negative driving voltage for driving the organic light emitting display panel.

According to example embodiments, a display device may include a display panel, a driving unit and a DC-DC converter.

The display panel may include a plurality of pixels that operate based on a first driving voltage, a second driving voltage, and a data signal. The driving unit provides the data signal to the display panel. The DC-DC converter may be configured to output the first driving voltage and the second driving voltage through a power line to detect whether the display panel is shorted based on a short detection reference that is adjusted according to an operation mode of the display panel to shut down based on a result of the detection. The DC-DC converter may include a voltage conversion unit configured to generate a first DC voltage and a second DC voltage for driving the display panel based on an input voltage and a short detection unit configured to adjust the short detection reference based on a detection control signal and to detect whether the display panel is shorted based on the adjusted short detection reference.

In example embodiments, the driving unit may provide black data to the display panel in a start-up mode, the black data corresponding to a black image, and the driving unit provides valid data to the display panel in a normal operation mode, the valid data corresponding to a valid image.

In the start-up mode, the short detection unit may set the short detection reference to a first short detection reference based on the detection control signal, and the short detecting unit may perform a first short detection using the first short detection reference.

In the normal operation mode, the short detection unit may set the short detection reference to a second short detection reference based on the detection control signal, and the short detection unit may perform a second short detection using the second short detection reference.

According to example embodiments, a method of controlling a driving voltage may include generating a DC voltage for driving a display panel based on an input voltage, generating the driving voltage based on the DC voltage, performing a short detection to detect whether the display panel is shorted based on a short detection reference that is adjusted according to an operation mode of the display panel, and shutting down a DC-DC converter that generates the driving voltage based on a result of the short detection.

In example embodiments, performing the short detection may include providing black data to the display panel in a start-up mode, the black data corresponding to a black image, setting the short detection reference to a first short detection reference based on a detection control signal in the start-up mode, performing a first short detection based on the first short detection reference in the start-up mode, providing valid data to the display panel in a normal operation mode if a short event is not detected during the start-up mode, the valid data corresponding to a valid image, setting the short detection reference to a second short detection reference based on the detection control signal in the normal operation mode, and performing a second short detection based on the second short detection reference in the normal operation mode.

BRIEF DESCRIPTION OF THE DRAWINGS

The above and other features will become more apparent to those of ordinary skill in the art by describing in detail exemplary embodiments thereof with reference to the attached drawings in which.

DETAILED DESCRIPTION

Example embodiments will now be described more fully hereinafter with reference to the accompanying drawings; however, they may be embodied in different forms and should not be construed as limited to the embodiments set forth herein.

It will be understood that, although the terms first, second, etc. may be used herein to describe various elements, these elements should not be limited by these terms. These terms are used to distinguish one element from another. For example, a first element could be termed a second element, and, similarly, a second element could be termed a first element, without departing from the scope of present embodiments. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments and is not intended to be limiting of present embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Figure 1:
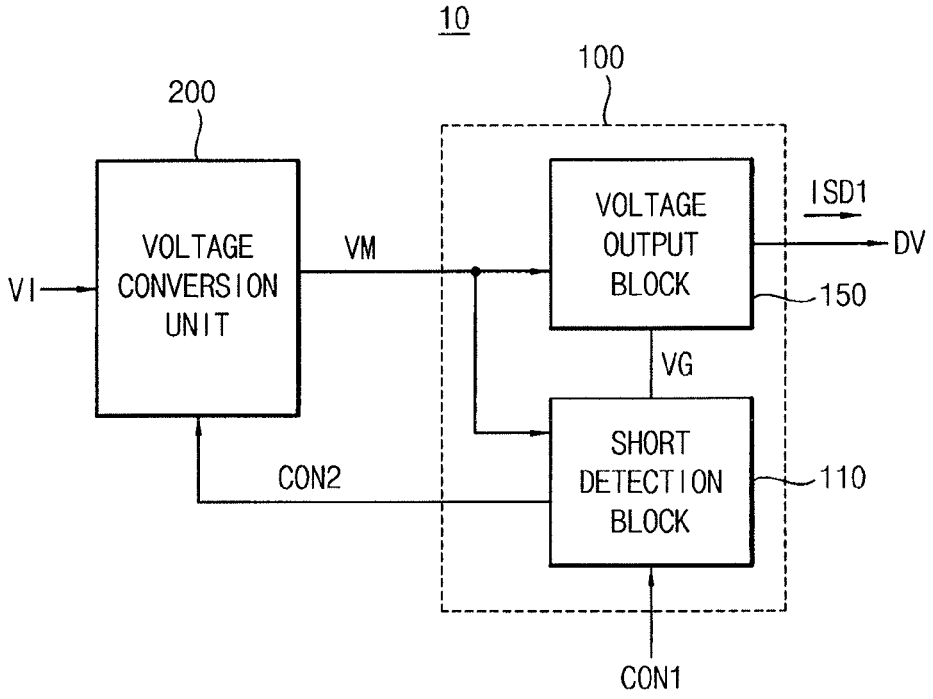
FIG. 1 is a block diagram illustrating a DC-DC converter in accordance with example embodiments.

FIG. 1 is a block diagram illustrating a DC-DC converter in accordance with example embodiments.

Referring to FIG. 1, a DC-DC converter 10 includes a voltage conversion unit 200 and a short detection unit 100. The short detection unit 100 may include a voltage output block 150 and a short detection block 110.

The voltage conversion unit 200 generates a DC voltage VM for driving a display panel based on an input voltage. The DC voltage VM may include various voltages for driving the display panel, such as positive driving voltages, negative driving voltages, etc. In example embodiments, the voltage conversion unit 200 may include a boost DC-DC converter and/or an inverting buck-boost DC-DC converter.

The short detection unit 100 generates a driving voltage DV based on the DC voltage VM to output the driving voltage DV through a power line DV. The DC-DC converter 10 may apply the driving voltage DV to the display panel through the power line DV to allow a driving current ISD1 to flow through the display panel. When a short event occurs at the display panel, the driving current ISD1 may have a relatively greater current level than when the display panel operates in a normal operation mode because of the short event.

The short detection unit 100 may detect various short events concerning the power line DV. For example, the short event may include an event in which a short occurs between lines arranged in the display panel to provide the driving voltage DV into the display panel. When the short event occurs at the display panel, a current having a relatively greater current level may flow through the power line DV than when the display panel operates in the normal operation mode. The current ISD1 flowing through the power line when the short event occurs at the display panel may be referred to as a short current or an over current. For example, a reference value for determining whether the short event occurs may depend on a short detection reference of the short detection unit 100.

The short detection unit 100 performs a short detection to detect whether the display panel or the power line DV is shorted based on the short detection reference. The short detection reference may represent sensitivity of the short detection or a degree of precision of the short detection. For example, in a case where a current having a predetermined level flows through the power line DV, it may be determined by the short detection unit 100 that a short event occurs at the display panel if the short detection reference has a first value lower than the predetermined level. The short detection reference has a first value may be referred to as a first short detection reference. Alternatively, it may be determined by the short detection unit 100 that a short event does not occur at the display panel if the short detection reference has a second value lower than the predetermined level. The short detection reference of the second value may be referred to as a second short detection reference.

The first short detection reference may be used to detect a short event in which a minute short current flows while a black data is displayed in the display panel. The black data may correspond to a black image. For example, when the black data is displayed in the display panel, a current flowing through the power line DV may have substantially 0 mA. Thus, when the short event that causes a fine short current occurs, the short detection unit 100 may perform the short detection more sensitively than when a valid data is applied to the display panel, by setting up a threshold value of the first short detection reference to be lower than that of the second short detection reference.

The second short detection reference may be used to detect a short event in which a relatively large short current flows while a valid data is displayed in the display panel. The valid data may correspond to a valid image. For example, a threshold value of the second short detection reference may be set to determine whether a relatively greater current flows through the power line DV than that of when a full white image is displayed in the display panel. A current flowing through the power line DV while the full white image is displayed in the display panel may vary according to brightness or a size of the display panel that is set up by a user. Thus, in some embodiments, the second short detection reference may be changed according to the brightness or the size of the display panel.

The display panel may display different images, for example, a black data or a valid data according to the operation mode. The display panel will be described in detail below with reference to FIGS. 11 and 13. The short detection unit 100 may perform the short detection based on a comparison level. A short detecting operation of the short detection unit 100 will be described in detail below with reference to FIGS. 5 and 6.

The short detection unit 100 may include the voltage output block 150 and the short detection block 110.

The voltage output block 150 may stabilize a DC voltage VM to generate a driving voltage DV. Thus, the short detection unit 100 may output a stabilized driving voltage DV to the power line DV by the voltage output block 150. The voltage output block may include a voltage regulator such as a low-dropout regulator. In other words, the short detection unit 100 may include at least one low-dropout regulator. In this case, the low-dropout regulator may output a driving voltage DV for driving the display panel through the power line DV.

The short detection block 110 may generate a sensing current proportional to a current ISD1 flowing through the power line DV. The sensing current flows through the inside of the short detection block 110. The sensing current may be generated based on a control voltage VG controlled by the voltage output block 150. For example, short detection block 110 may generate a sensing voltage level based on a detection control signal CON1 concerning the sensing current and the operation mode. The short detection block 110 may be controlled by the detection control signal CON1 such that the sensing voltage level has different sensitivity with respect to a magnitude of the sensing current according to the operation modes. The short detection block 110 may determine based on the sensing voltage level whether a current ISD1 flowing through the power line DV is by the short event.

In example embodiments, the short detection unit 100 may generate a shut-down control signal CON2 based on whether the short event is detected. For example, the shut-down control signal CON2 may be a one-bit analog or digital signal having a high level or a low level. The voltage conversion unit 200 may be shut down based on the shut-down control signal CON2. Thus, when the short event occurs, the DC-DC converter 10 may prevent a short current from continuously flowing through the display panel by shutting down the voltage conversion unit 200 based on the shut-down control signal CON2, thereby reducing heating and additional damage on a device.

Referring now to FIG. 1, the short detection block 110 may convert the short current or the over current to the comparison level by using converting methods having different sensitivity. For example, the short detection block 110 may generate the comparison level based on a short detection reference such as the sensitivity of the short detection or the degree of precision of the short detection. The short detection reference may have different threshold values of detection according to the operation mode. When a magnitude of the sensing current is greater than that of a current corresponding to the threshold value of detection, the short detection block 110 may determine that a short event occurs and may activate the shut-down control signal CON2. The voltage conversion unit 200 may be shut down by receiving the activated shut-down control signal CON2. For example, the shut-down control signal CON2 may have a logic high level or a logic low level when it is activated or deactivated, respectively.

In example embodiments, the short detection unit 100 may receive a detection enable signal. The short detection unit 100 may perform the short detection based on the short detection reference when the detection enable signal is activated.

Generally, a short generated in a line for transmitting the driving voltage DV to the display panel is detected by sensing a voltage drop of the driving voltage DV. When the short event occurs, a current flowing through the power line DV increases rapidly, and thus a sensing voltage level of the driving voltage DV may change differently from the driving voltage DV. In sensing the voltage drop of the driving voltage, it is determined that a short event occurs when the driving voltage drops below a predetermined reference level.

However, such voltage drop represents a short event that causes a relatively large short current occurs. When a short event occurs within driving capability of a power supply device such as a DC-DC converter, the short event may not be detected. Thus, the power supply device may continuously provide a driving power to the display panel through the power line DV even when the short event occurs. For example, if the power supply device is designed to have an output of about 200 mA with respect to when the display panel displays a white image and if a weak short event occurs while displaying a gray image having a lower pixel value, a value of a load resistor caused by the weak short event may be recognized as a load resistor within the driving capability of the power supply device. Thus, a short protection circuit may not protect a short current. If a power is continuously provided to the display panel in spite of a short event, heating and damage may be continuously generated. As described above, because a degree of precision for detecting a short current may vary according to a display data displayed in the display panel, a short detection and short detection reference for a short protection need to be changed according to a driving mode of the display panel.

The DC-DC converter 100 in accordance with example embodiments may detect a short generated in a driving object such as a display panel, based on various short event detection references controlled according to an operation mode of the driving object. The driving object may allow a current to flow through power line DV, and a magnitude of the current may vary according to the operation mode. Thus, the DC-DC converter 100 in accordance with example embodiments may effectively detect a short generated in the driving object or the power line DV by changing a detection reference or a threshold value of detection according to the operation mode.

Figure 2:
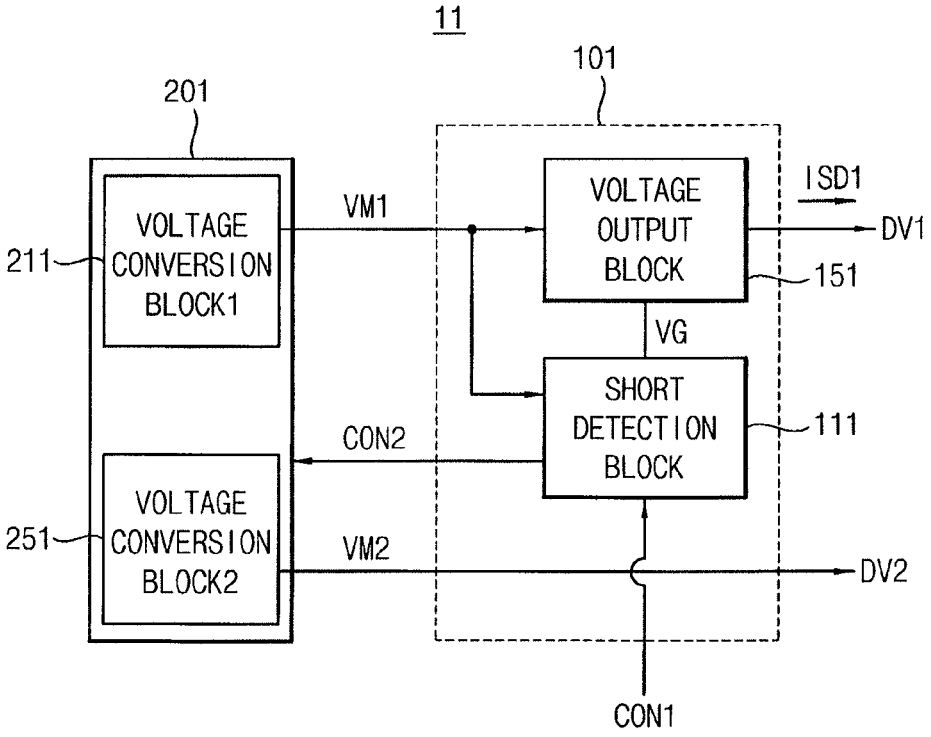
FIGS. 2 and 3 are block diagrams illustrating examples of a DC-DC converter of FIG. 1.
Figure 3:
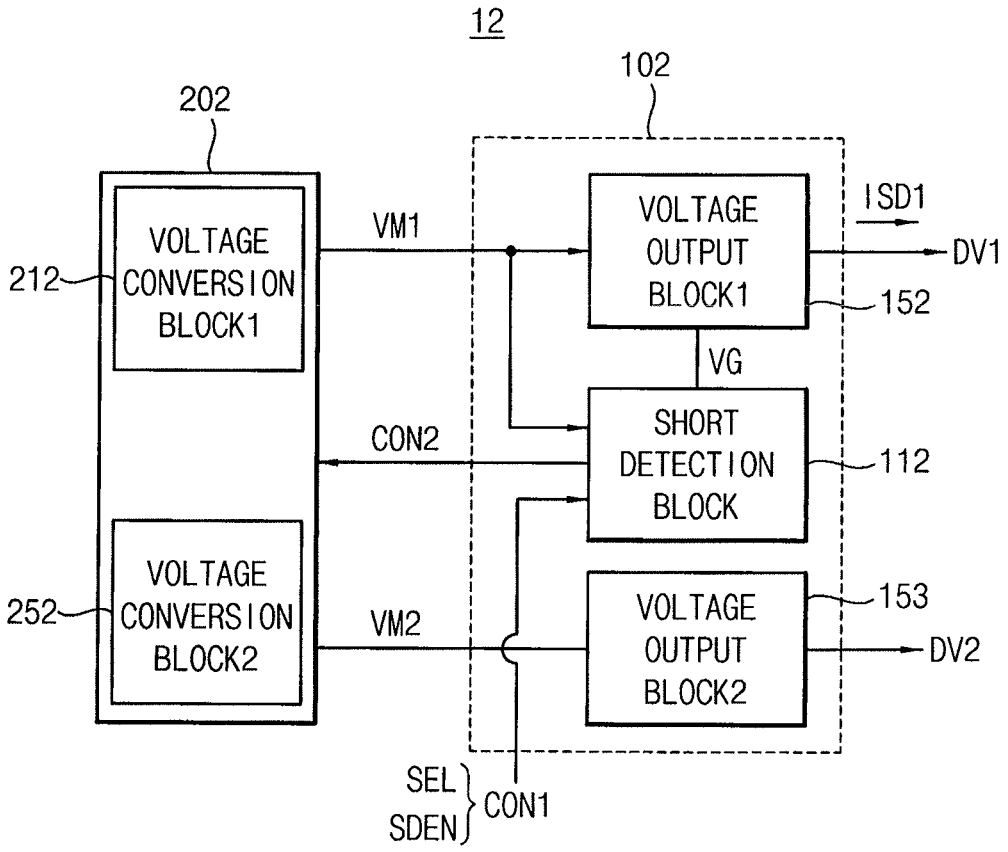

FIGS. 2 and 3 are block diagrams illustrating examples of a DC-DC converter of FIG. 1.

Referring to FIG. 2, a DC-DC converter 11 includes a voltage conversion unit 201 and a short detection unit 101. The short detection unit 101 may include a voltage output block 151 and a short detection block 111.

The voltage conversion unit 201 generates a plurality of DC voltages VM1 and VM2 for driving a display panel based on an input voltage. For convenience of description, only a pair of DC voltages VM1 and VM2 is illustrated in FIGS. 2 and 3. The voltage conversion unit 201 may include a first voltage conversion block 211 and a second voltage conversion block 251. The first and the second voltage conversion blocks 211 and 251 may generate the first DC voltage VM1 and the second DC voltage VM2, respectively. For example, the first voltage conversion block 211 may generate the first DC voltage VM1 having a positive level based on the input voltage, and the second voltage conversion block 251 may generate the second DC voltage VM2 having a negative level based on the input voltage. Each of the first and the second voltage conversion blocks 211 and 251 may be deactivated or shut down when the shut-down control signal CON2 is activated.

The short detection unit 101 may generate driving voltages DV1 and DV2 based on the DC voltages VM1 and VM2, and may output the driving voltages DV1 and DV2 through power lines DV1 and DV2. The display panel may include an organic light emitting display panel. The driving voltages DV1 and DV2 may include a positive driving voltage (ELVDD) and a negative driving voltage (ELVSS) for driving the organic light emitting display panel.

The voltage output block 151 may stabilize the DC voltage VM1 to generate the first driving voltage DV1. The short detection block 111 may generate a sensing current proportional to a current ISD1 flowing through the first power line DV1. The sensing current may be generated based on a control voltage VG applied by the voltage output block 151.

The DC-DC converter 11 of FIG. 2 is substantially the same as the DC-DC converter 10 of FIG. 1 except for generating the plurality of driving voltages DV1 and DV2.

Referring to FIG. 3, a DC-DC converter 12 includes a voltage conversion unit 202 and a short detection unit 102. The short detection unit 102 may include a first voltage output block 152, a second voltage output block 153 and a short detection block 112. The voltage conversion unit 202 may include a first voltage conversion block 212 and a second voltage conversion block 252.

The short detection unit 102 generates driving voltages DV1 and DV2 based on DC voltages VM1 and VM2, and outputs the driving voltages DV1 and DV2 through power lines DV1 and DV2. The first voltage output block 152 may stabilize the DC voltage VM1 to generate the first driving voltage DV1. The second voltage output block 153 may stabilize the DC voltage VM2 to generate the second driving voltage DV2. Each of the voltage output blocks 152 and 153 may include a voltage regulator such as a low-dropout regulator. The short detection block 112 may generate a sensing current substantially proportional to a current ISD1 flowing through the first power line DV1. The sensing current may be generated based on a control voltage VG applied by the voltage output block 152.

The DC-DC converter 12 of FIG. 3 is substantially the same as the DC-DC converter 11 of FIG. 2 except for further including the second voltage output block 153 for stabilizing the second driving voltage DV2.

Figure 4:
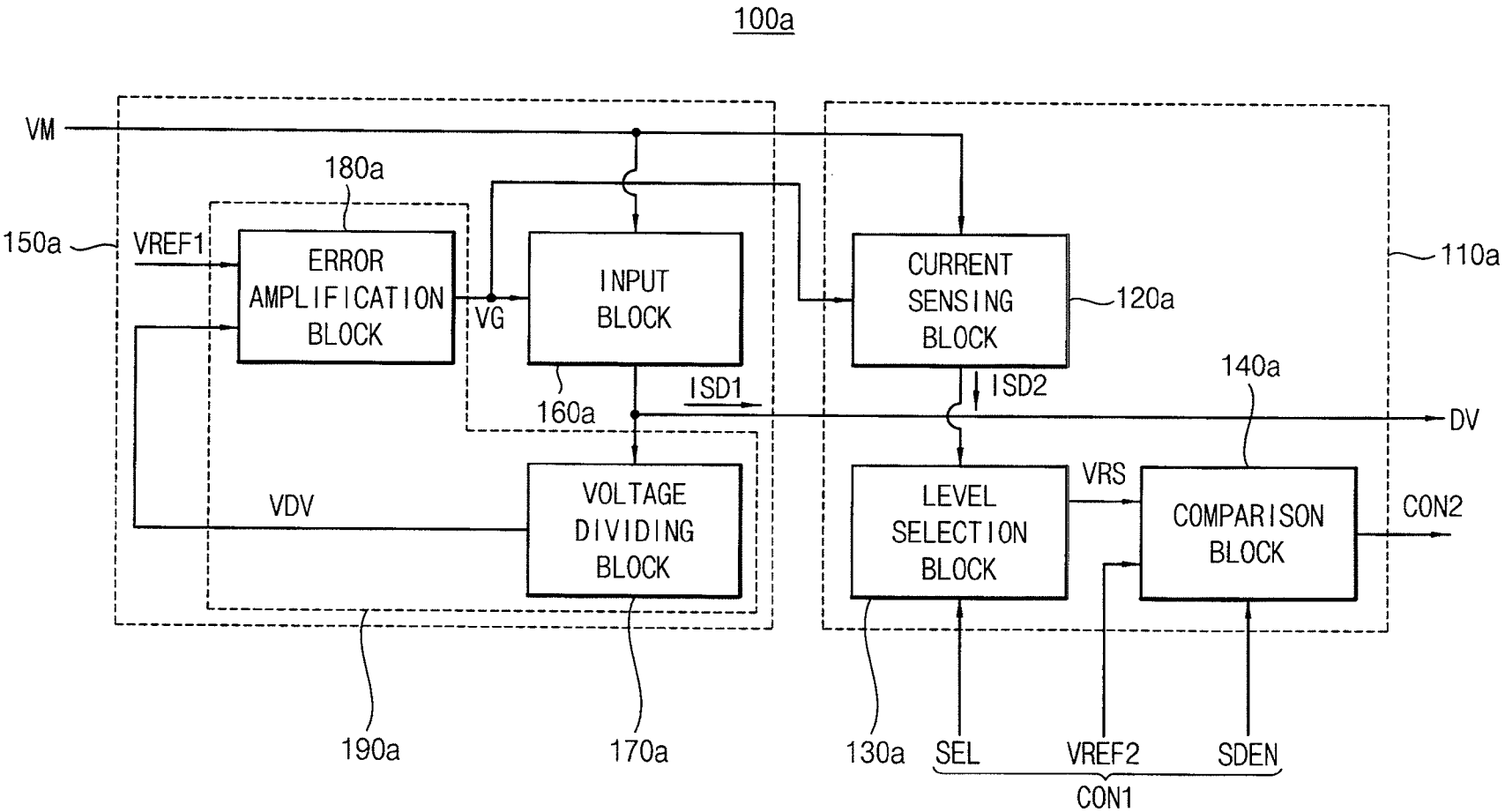
FIG. 4 is a block diagram illustrating an example of a short detection unit of FIG. 1.

FIG. 4 is a block diagram illustrating an example of a short detection unit of FIG. 1. FIG. 4 illustrates an example of the short detection unit 100 when a driving voltage DV has a positive level, but not limited thereto. In other words, function blocks of FIG. 4 may also be employed when the driving voltage DV has a negative level.

Referring to FIG. 4, a short detection unit 100*a* includes a voltage output block 150*a* and a short detection block 110*a*.

The voltage output block 150*a* may include an input block 160*a* and a voltage control block 190*a*.

The input block 160*a* may stabilize an output voltage VM of the voltage conversion unit 200 based on a control voltage VG of the voltage control unit 190*a*. The input block 160*a* may output the stabilized voltage through a power line DV.

The voltage control block 190*a* may include a voltage division block 170*a* and error amplification block 180*a*. The voltage division block 170*a* may divide the driving voltage DV by a division ratio to generate a divided voltage VDV. The error amplification block 180*a* may generate a first control voltage VG by comparing the divided voltage VDV and an amp reference voltage VREF1 and may apply the first control voltage VG to the input block 160*a*. The input block 160*a* may transmit the output voltage VM of the voltage conversion unit 200 to the power line DV based on the first control voltage VG. In example embodiments, the input block 160*a* may stabilize the output voltage VM of the voltage conversion unit 200 based on the first control voltage VG or may change a sensing voltage level.

The short detection block 110*a* may include a current sensing block 120*a*, a level selection block 130*a* and a comparison block 140*a*.

The current sensing block 120*a* is coupled between an output voltage line VM of the voltage conversion unit 200 and the level selection block 130*a*. The current sensing block 120*a* may generate a sensing current ISD2 proportional to a current ISD1 flowing through the power line DV, based on the first control voltage VG. The current sensing block 120*a* may apply the sensing current ISD2 to the level selection block 130*a*.

The level selection block 130*a* may generate a sensing voltage level VRS for performing the short detection. The sensing voltage level VRS may have a magnitude corresponding to that of the sensing current ISD2 and may have different sensitivity of detection according to the operation mode. For example, the sensing voltage level VRS may be obtained by multiplying the sensing current IDS2 by a coefficient which depends on the operation mode. When the same sensing current IDS2 flows in the different operation mode, a threshold level for activating or deactivating a shut-down control signal CON2 may vary according to the different operation mode.

The comparison block 140*a* may generate the shut-down control signal CON2 by comparing the sensing voltage level VRS and a level of a reference voltage VREF2. The reference voltage VREF2 may be set up by an external control signal or may be programmed to a predetermined value by cutting a fuse. For example, the comparison block 140*a* may activate the shut-down control signal CON2 when the sensing voltage level VRS is greater than that of the reference voltage VREF2 and may deactivate the shut-down control signal CON2 when the sensing voltage level VRS is smaller than that of the reference voltage VREF2.

A detection control signal CON1 may include a level selection signal SEL, the reference voltage VREF2 and a short detection enable signal SDEN. The level selection block 130*a* may generate the sensing voltage level VRS based on the level selection signal SEL. The short detection reference for performing the short detection may be decided by the level selection signal SEL. The comparison block 140*a* may be activated or deactivated based on the short detection enable signal SDEN. For example, when the comparison block 140*a* is deactivated, the comparison block 140*a* may deactivate the shut-down control signal CON2 regardless of the sensing voltage level VRS.

Figure 5:
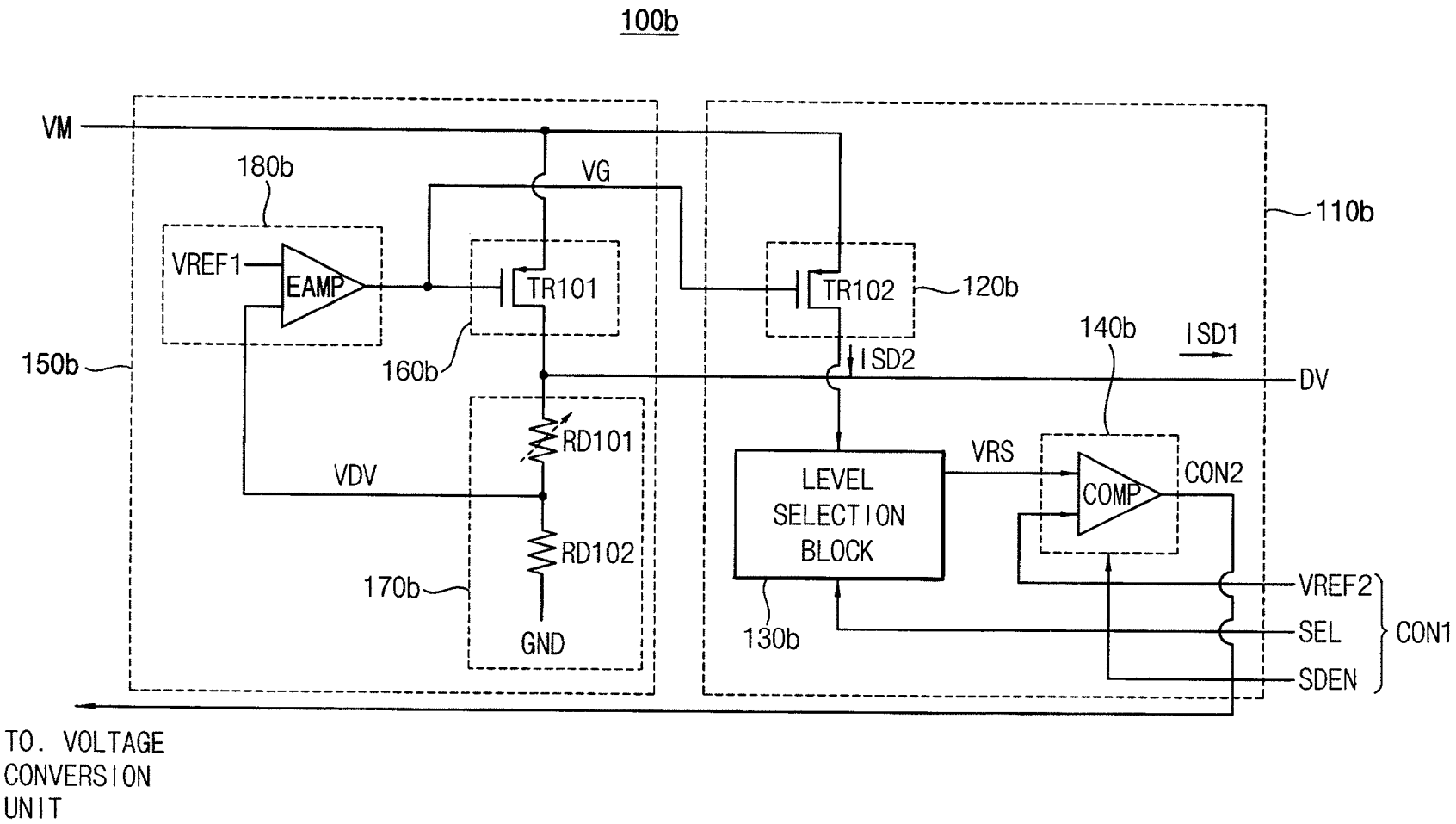
FIG. 5 is a diagram illustrating an example of a short detection unit of FIG. 4.

FIG. 5 is a diagram illustrating an example of a short detection unit of FIG. 4.

Referring to FIG. 5, a short detection unit 100*b* includes a voltage output block 150*b* and a short detection block 110*b*. The voltage output block 150*b* may include an input block 160*b*, a voltage division block 170*b* and an error amplification block 180*b*. The short detection block 110*b* may include a current sensing block 120*b*, a level selection block 130*b*, and a comparison block 140*b*.

The input block 160*b* may include a pass transistor TR101. A source of the pass transistor TR101 may be coupled to an output voltage line VM of the voltage conversion unit 200. A drain of the pass transistor TR101 may be coupled to the voltage division block 170*b*. A first control voltage VG may be applied to a gate of the pass transistor TR101. Thus, the first control voltage VG may open and close the pass transistor TR101.

The voltage division block 170*b* may include resistors RD101 and RD102. The resistors RD101 and RD102 may be coupled in series between the pass transistor TR101 and a ground GND. The voltage division block 170*b* may divide a voltage between the power line DV and the ground GND based on the resistors RD101 and RD102, thereby generating a second control voltage VDV. In example embodiments, the resistor RD101 may be a variable resistor. Further, the ground GND may be coupled to another reference voltage instead of being grounded.

The error amplification block 180*b* may include an error amplifier EAMP. The error amplifier EAMP may generate the first control voltage VG based on the second control voltage VDV and an amp reference voltage VREF1.

When a current flowing through the pass transistor TR101 increases, a level of the second control voltage VDV increases. The error amplifier EAMP may deactivate the first control voltage VG when a level of the second control voltage VDV increases above that of the amp reference voltage VREF1. Alternatively, the error amplifier EAMP may activate the first control voltage VG when a level of the second control voltage VDV decreases below that of the amp reference voltage VREF1. Thus, the voltage output block 150*b* may be operated as a voltage regulator such as a low-dropout regulator.

The current sensing block 120*b* may include a sensing transistor TR102. The sensing transistor TR102 may be arranged in a current mirror structure with the pass transistor TR101. The transistors TR101 and TR102 may have gates in common. For example, a source of the sensing transistor TR102 may be coupled to the output voltage line VM of the voltage conversion unit 200 and a drain of the sensing transistor TR102 may be coupled to the level selection block 130*b*. The first control voltage VG applied to the gate of the pass transistor TR101 may be applied to a gate of the sensing transistor TR102. A magnitude of a sensing current ISD2 may be proportional to that of a driving current ISD1 flowing through the power line DV coupled to the pass transistor TR101. For example, a magnitude of the sensing current ISD2 may be smaller than that of the driving current ISD1 by m times, where m is a positive integer greater than 1. The sensing current ISD2 may flow through the sensing transistor TR102 and the level selection block 130*b*.

The comparison block 140*b* may include a comparator COMP. The comparator COMP may generate a shut-down control signal CON2 by comparing a sensing voltage level VRS and a reference voltage VREF2.

As described above, the short detection unit 100*a* may perform the short detection by comparing the sensing voltage level VRS and the reference voltage VREF2 where the sensing voltage level VRS is decided based on a magnitude of the driving current ISD1 and the short detection reference.

The short detection unit 100*b* of FIG. 5 is substantially the same as the short detection unit of FIG. 4 except for circuit construction.

Figure 6A:
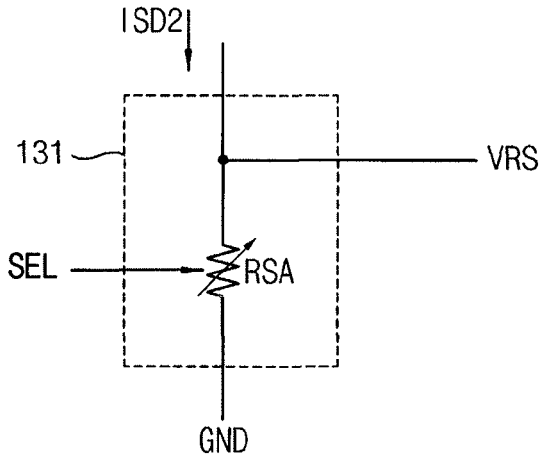
FIGS. 6A to 6C are circuit diagrams illustrating examples of a level selection block of FIG. 5.
Figure 6B:
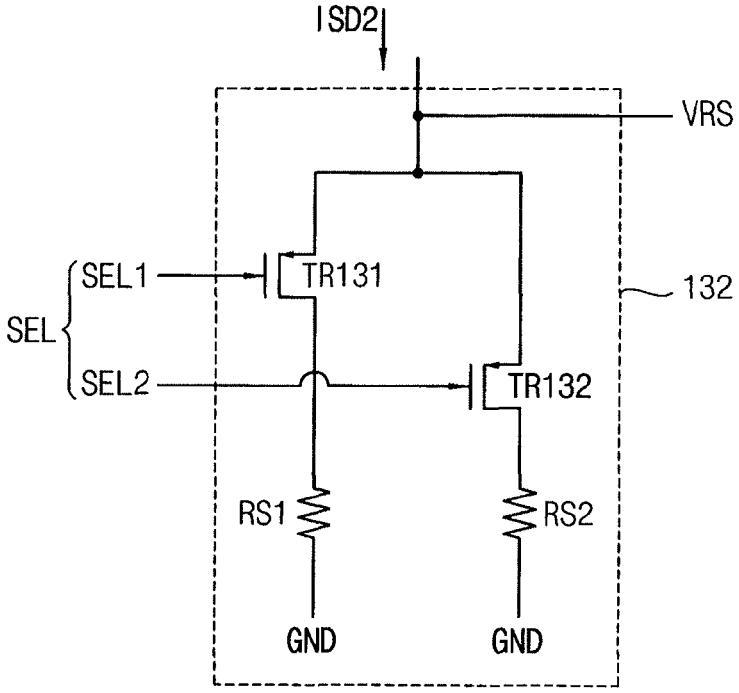
Figure 6C:
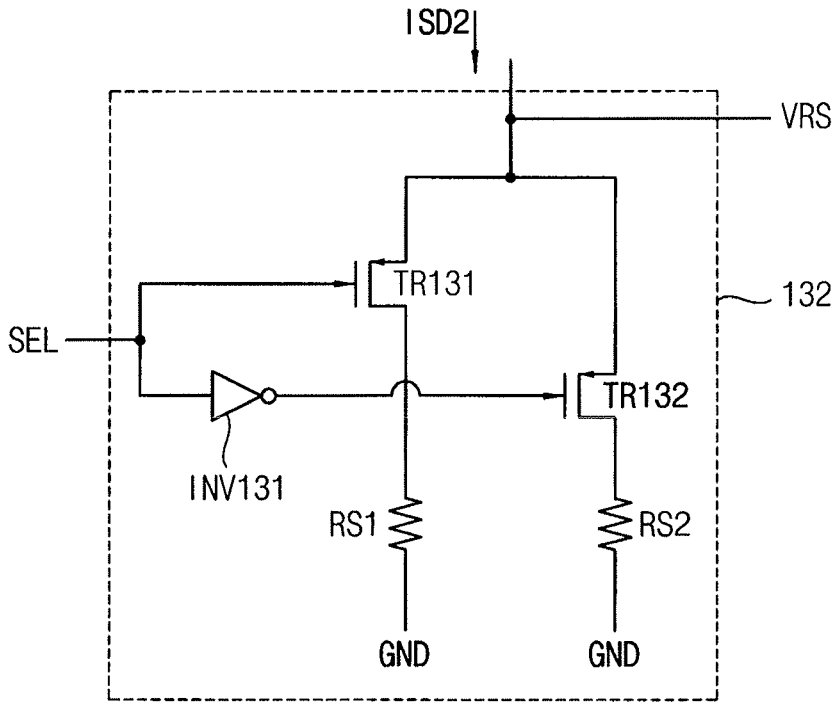

FIGS. 6A to 6C are circuit diagrams illustrating examples of a level selection block of FIG. 5. Although the number of resistors is limited in FIGS. 6B and 6C for convenience of description, the number of resistors is not limited thereto.

Referring to FIG. 6A, a level selection block 131 may include a variable resistor RSA. The variable resistor RSA may be coupled between the current sensing block 120*a* and the ground GND. A value of the variable resistor RSA may be decided based on a selection signal SEL. The level selection block 131 may generate a sensing voltage level VRS based on the value of the variable resistor RSA. In example embodiments, the variable resistor RSA may be controlled to have a relatively large value in the start-up mode and may be controlled to have a relatively small value in the normal operation mode.

Referring to FIG. 6B, a level selection block 132 may include a plurality of switches TR131 and TR132 and a plurality of resistors RS1 and RS2. Each of the switches TR131 and TR132 may include one transistor. The switches TR131 and TR132 may open and close based on level selection signals SEL1 and SEL2, respectively. The resistors RS1 and RS2 may be coupled to the switches TR131 and TR132 in series, respectively. A sensing voltage level VRS may be generated as a sensing current flows through the resistors RS1 and RS2 according to open and close of the switches TR131 and TR132.

In example embodiments, the resistors RS1 and RS2 may include a first resistor RS1 and a second resistor RS2. The first resistor RS1 may have a value for generating the sensing voltage level VRS, and the value of the sensing voltage level VRS is for a short detection in the start-up mode of the display panel. The second resistor RS2 may have a value for generating the sensing voltage level VRS, and the value of the sensing voltage level VRS is for a short detection in the normal operation mode of the display panel. For example, a magnitude of the first resistor RS1 may be greater than that of the second resistor RS2 by k times, where k is a positive integer greater than 1.

Referring to FIG. 6C, a level selection block 132 may include a plurality of switches TR131 and TR132, an inverter INV131 and a plurality of resistors RS1 and RS2. The switches TR131 and TR132 may open and close based on a level selection signal SEL and a signal inverted by the inverter INV131, respectively. A sensing voltage level VRS may be generated as a sensing current selectively flows through the resistors RS1 and RS2 according to opening and closing of the switches TR131 and TR132.

Figure 7:
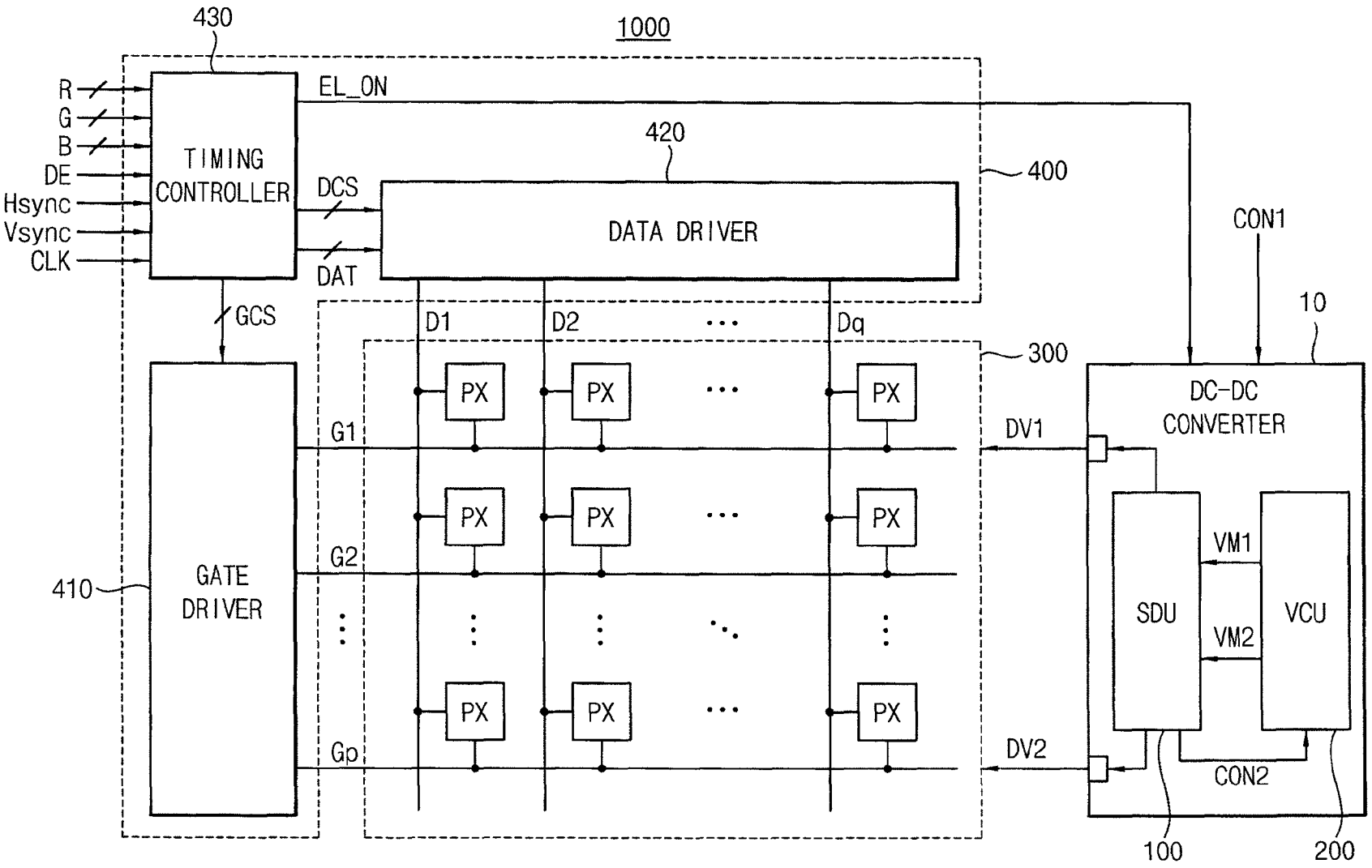
FIG. 7 is a diagram illustrating a display device in accordance with example embodiments.

FIG. 7 is a diagram illustrating a display device in accordance with example embodiments.

Referring to FIG. 7, a display device 1000 includes a display panel 300, a DC-DC converter 10 and a driving unit 400. The display panel 300 includes a plurality of pixels operating in response to a first driving voltage DV1, a second driving voltage DV2 and data signals D1, D2, . . . , Dq. The DC-DC converter 10 outputs the first and the second driving voltages DV1 and DV2 through power lines DV1 and DV2. The DC-DC converter 10 detects whether the display panel 300 is shorted based on a short detection reference adjusted according to an operation mode of the display panel 300. The DC-DC converter 10 is shut down according to a result of the short detection. The driving unit 400 provides the data signals D1, D2, . . . , Dq to the display panel 300 and provides control signals CON1 and EL_ON.

The display panel 300 may include a plurality of pixels PX arranged in a matrix form. The plurality of pixels PX may be connected to a plurality of gate lines G1, G2, . . . , Gp and to a plurality of data lines D1, D2, . . . , Dq, where p and q represent positive integers. Each of the plurality of pixels PX may operate in response to the driving voltages DV1 and DV2, gate signals G1, G2, . . . , Gp and the data signals D1, D2, . . . , Dq.

The driving unit 400 may include a gate driver 410, a data driver 420, and a timing controller 430.

The timing controller 430 may receive RGB image signal R, G and B, a vertical synchronization signal Vsync, a horizontal synchronization signal Hsync, a main clock signal CLK and a data enable signal DE from an external graphic controller (not illustrated), and generate an output image signal DAT, a data control signal DCS, a gate control signal GCS and a first control signal EL_ON. The timing controller 430 may provide the gate control signal GCS to the gate driver 410, provide the output image signal DAT and the data control signal DCS to the data driver 420, and provide the first control signal EL_ON to the DC-DC converter 10. For example, the gate control signal GCS may include a vertical synchronization start signal, which controls a start of outputting the gate signals G1, G2, . . . , Gp, a gate clock signal, which controls an output timing of the gate signals G1, G2, . . . , Gp and an output enable signal, which controls a duration of the gate signals. The data control signal DCS may include a horizontal synchronization start signal, which controls a start of outputting the data signals D1, D2, . . . , Dq, a data clock signal, which controls an output timing of the data signals D1, D2, . . . , Dq, and a load signal.

The driving unit 400 may transmit a black data to the display panel 300 in the start-up mode. The black data may correspond to a black image displayed in the display panel 300. The driving unit 400 may transmit a valid data to the display panel 300 in the normal operation mode. The valid data may correspond to a valid image. The short detection unit 100 may perform a first short detection by a first short detection reference in a start-up mode. In this case, the short detection unit 100 may set the short detection reference to the first short detection reference based on the detection control signal CON1. The short detection unit 100 may perform a second short detection by a second short detection reference in a normal operation mode. In this case, the short detection unit 100 may set the detection reference to the second short detection reference based on the detection control signal CON1. According to example embodiments, the first short detection reference may be for detecting a relatively small short current. Since the first and the second short detection references are fully described above, detailed description will be omitted here.

The gate driver 410 may sequentially apply the gate signal to the gate lines G1, G2, . . . , Gp in response to the gate control signal GCS.

The data driver 420 may apply the data signal to the data lines D1, D2, . . . , Dq in response to the data control signal DCS and the output image signal DAT.

The DC-DC converter 10 may provide the driving voltages DV1 and DV2 to the display panel 300 in response to the first control signal EL_ON received from the timing controller 430. In example embodiments, the first driving voltage DV1 may be a positive driving voltage ELVDD and the second driving voltage DV2 may be a negative driving voltage ELVSS. In some example embodiments, the first driving voltage DV1 may be a negative driving voltage ELVSS and the second driving voltage DV2 may be a positive driving voltage ELVDD.

Referring now to FIGS. 1, 2 and 7, the DC-DC converter 10 may include the voltage conversion unit 200 and the short detection unit 100. The voltage conversion unit 200 may generate a first DC voltage VM1 and a second DC voltage VM2 for driving the display panel 300 based on an input voltage. The short detection unit 100 may control the short detection reference based on the detection control signal and may perform the short detection based on the controlled short detection reference. The short detection unit 100 may generate the shut-down control signal CON2 as a result of the short detection. The voltage conversion unit 200 may be shut down in response to the shut-down control signal CON2.

An operation mode of the display panel 300 may include a start-up mode and a normal operation mode. The short detection reference may be controlled based on the detection control signal CON1 as one of a first short detection reference and a second short detection reference according to the operation mode. For example, as illustrated in FIGS. 6B and 6C, the first short detection reference may be realized using the first resistor RS1 and the first switch TR131, and the second short detection reference may be realized using the second resistor RS2 and the second switch TR132. The short detection unit 100 may perform a first short detection and a second short detection according to the operation mode or the short detection reference. The short detection unit 100 may perform the first short detection based on the first short detection reference when the operation mode of the display panel 300 is a start-up mode, and may perform the second short detection based on the second short detection reference when the operation mode of the display panel 300 is a normal operation mode. For example, as illustrated in FIGS. 6B and 6C, the sensing voltage level VRS may be generated by the first resistor RS1 in the start-up mode, and may be generated by the second resistor RS2 in the normal operation mode. The first short detection reference may have a degree of precision relatively higher than or a threshold value of detection relatively lower than that of the second short detection reference. In other words, the first resistor RS1 may have a value relatively larger than that of the second resistor RS2. The driving unit 400 may apply a black data to the display panel 300 as a display data D1, D2, . . . , Dq in the start-up mode. Here, the black data corresponds to a black image. Further, a valid data may be applied to the display panel 300 as a valid display data D1, D2, . . . , Dq in the normal operation mode.

The DC-DC converter 10 of FIG. 7 may be realized using the DC-DC converter 10 of FIG. 1. Since the DC-DC converter 10 of FIG. 7 has a construction and an operation substantially the same as those of the DC-DC converter 10 of FIG. 1, detailed description will be omitted here.

According to example embodiments, the display device 1000 may detect a short generated in the display panel 300 or the power lines DV1 and DV2 based on the short event detection references. Here, the short event detection references are controlled according to the operation mode of the display panel 300. The display panel 300 may allow a current to flow through power lines DV1 and DV2, and a magnitude of the current may vary according to the operation mode. Thus, the display device 1000 including the DC-DC converter 100 in accordance with example embodiments may effectively detect a short by changing a detection reference or a threshold value of detection according to the operation mode.

Figure 8:
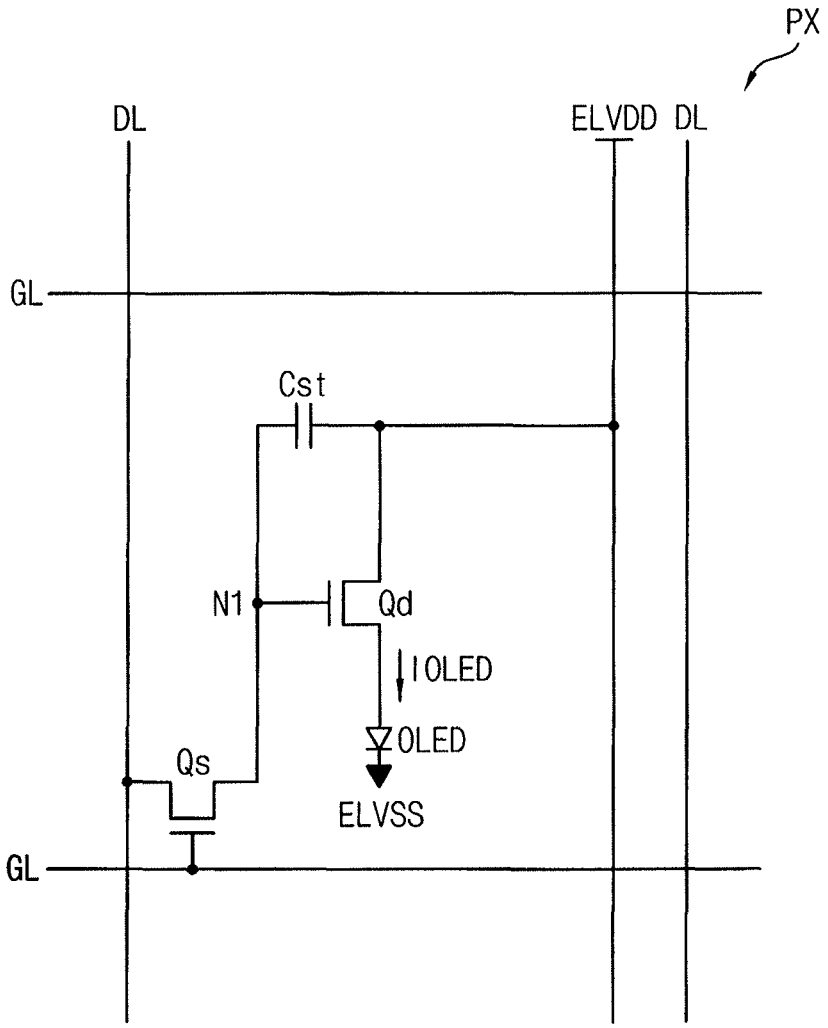
FIG. 8 is a circuit diagram illustrating an example of a pixel included in a display device of FIG. 7.

FIG. 8 is a circuit diagram illustrating an example of a pixel included in a display device of FIG. 7.

Referring to FIGS. 7 and 8, each of the plurality of pixels PX may include an organic light emitting diode (OLED), a driving transistor Qd, a switching transistor Qs and a storage capacitor Cst.

The switching transistor Qs may be turned on in response to the gate signal received through the gate line GL and provide the data signal DATA received through the data line DL to a first node N1. The storage capacitor Cst may store the data signal DATA provided from the switching transistor Qs. The driving transistor Qd may be turned on in response to a voltage provided from the switching transistor Qs and/or the storage capacitor Cst and flow a driving current IOLED corresponding to a magnitude of the data signal DATA. The driving current IOLED may be provided by a positive driving voltage ELVDD and a negative driving voltage ELVSS. Here, the positive driving voltage ELVDD may be provided to the pixels PX through the first power line DV1, and the negative driving voltage ELVSS may be provided to the pixels PX through the second power line DV2. An intensity of a light emitted from the organic light emitting diode (OLED) may be determined by an intensity of the driving current IOLED.

Since the plurality of pixels PX displays an image in response to a positive driving voltage ELVDD, a negative driving voltage ELVSS, a gate signal provided through the gate line GL and a data signal DATA provided through the data line DL, a wiring for the positive driving voltage ELVDD, a wiring for the negative driving voltage ELVSS, the gate line GL and the data line DL are formed to overlap on the display panel 300. Therefore, the wiring for the positive driving voltage ELVDD, the wiring for the negative driving voltage ELVSS, the gate line GL and the data line DL may be easily shorted with each other by a crack on the display panel and/or a foreign substance in the display panel 300.

As described above, the display device 1000 including the DC-DC converter 10 according to example embodiments may be able to detect minute short between wirings generated on the display panel 300 so that the display device 1000 stops operating.

Figure 9:
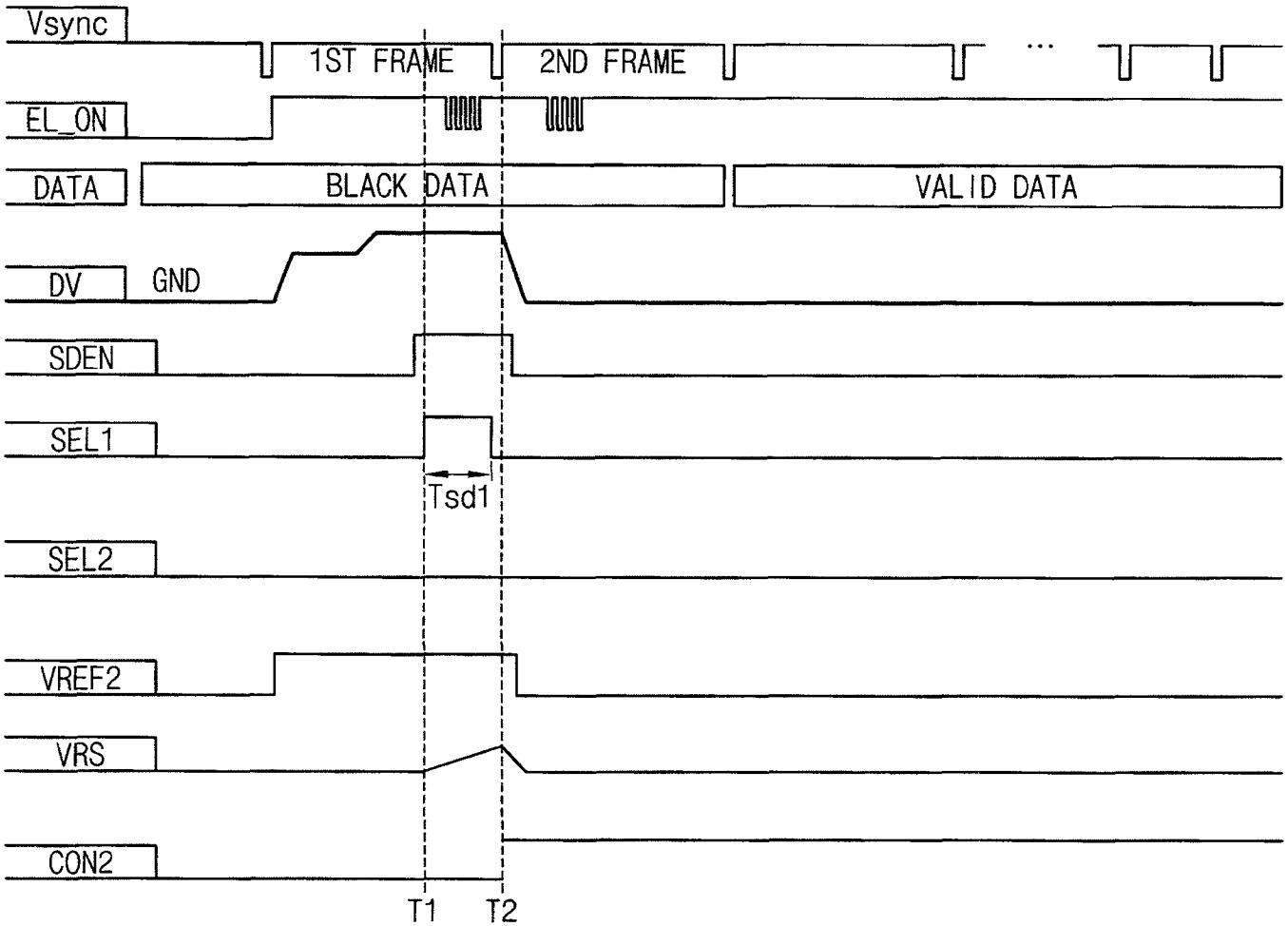
FIGS. 9 and 10 are timing diagrams for describing an operation of a DC-DC converter of FIG. 1.

FIG. 9 is a timing diagram for describing an operation of a DC-DC converter of FIG. 1.

Referring to FIGS. 6B, 7 and 9, the driving unit 400 may provide the first control signal EL_ON to the voltage conversion unit 200 included in the DC-DC converter 10 in synchronization with the vertical synchronization signal Vsync while the driving unit 400 provides a data signal corresponding to black color BLACK DATA to the display panel 300. During the start-up mode, the driving unit 400 may apply the data signal corresponding to black color BLACK DATA to the display panel 300, and the DC-DC converter 10 may activate or stabilize the power line DV to the driving voltages DV1 and DV2.

When one of the driving voltages DV1 and DV2, for example the positive driving voltage ELVDD or the negative driving voltage ELVSS is activated or stabilized, the driving unit 400 may activate the short detection enable signal SDEN and the first level selection signal SEL1. Here, as the first level selection signal SEL1 is activated, the first short detection reference for detecting the short event of the start-up mode may be realized. For example, as the first level selection signal SEL1 is activated, the short detection unit 100 included in the DC-DC converter 10 may perform the short detection using the first resistor RS1 of FIG. 6C. When the short detection enable signal SDEN and the first level selection signal SEL1 are activated, the short detection unit 100 included in the DC-DC converter 10 may detect the short event according to the first short detection reference during the a first short detection period Tsd1.

After the short detection enable signal SDEN is activated and the first level selection signal SEL1 is activated at a first point T1, when the short event occurs, the sensing voltage level VRS may become larger than a level of the short detection reference VREF2 at a second point T2. In this case, the short detection unit 100 may activate the shut-down control signal CON2, and the DC-DC converter 10 may be deactivated or shut down based on the activated shut-down control signal CON2. In example embodiments, the driving unit 400 may provide the short detection reference VREF2 of the DC-DC converter 10 to the short detection unit 100 for activating the short detection reference VREF2.

Since the short detection unit 100 and detecting the short event are fully described above, detailed description will be omitted here.

Figure 10:
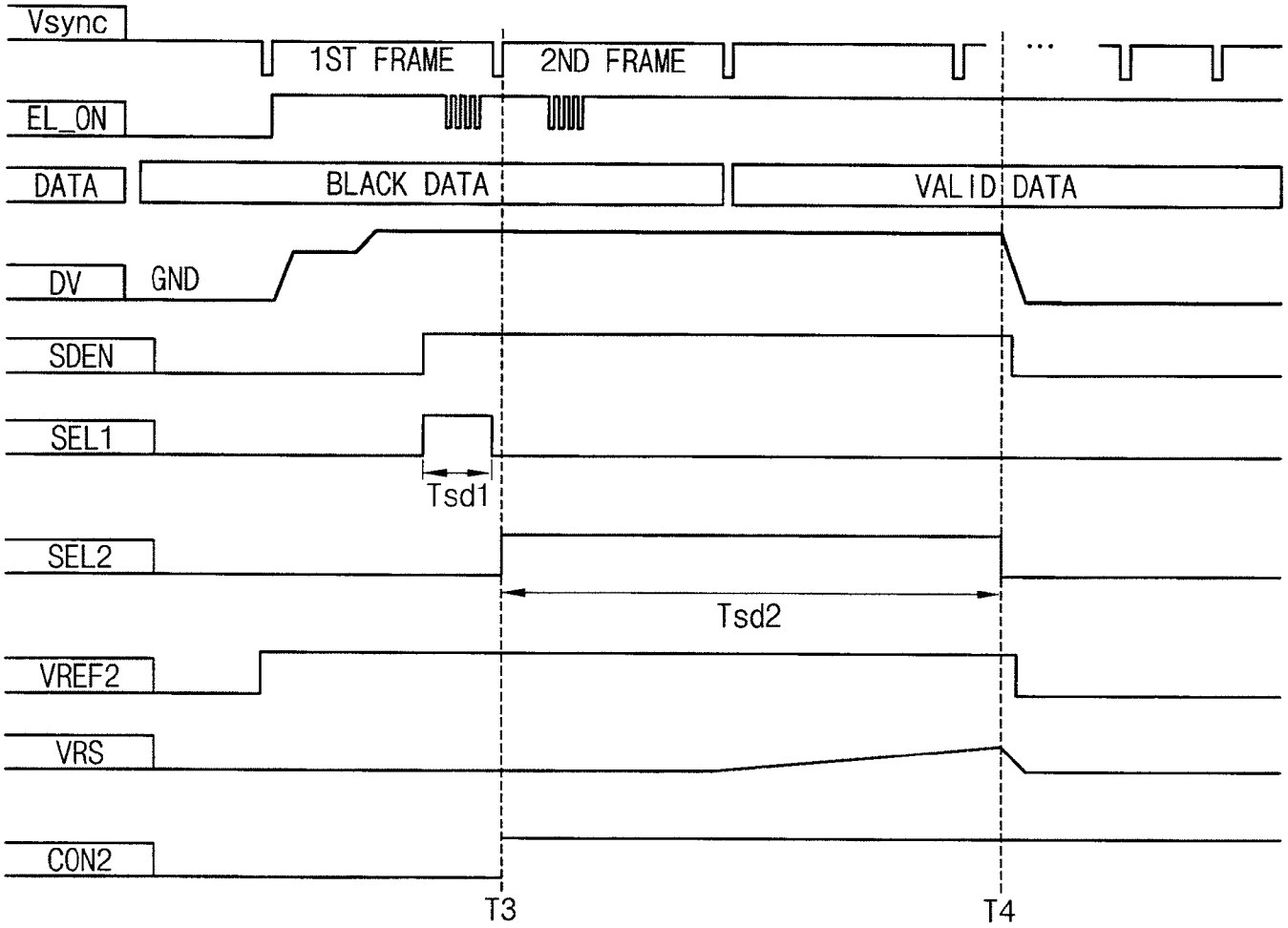

FIG. 10 is a timing diagram for describing an operation of a DC-DC converter of FIG. 1.

Referring to FIGS. 6B, 7 and 10, when a short is not detected during a first short detection period Tsd1, the DC- DC converter 10 may not be shut down because the shut-down control signal CON2 is deactivated. When a short event does not occur during the first short detection period Tsd1, the driving unit 400 may deactivate the first level selection signal SEL1 and may activate the second level selection signal SEL2 at a third point T3. In example embodiments, the driving unit 400 may control the first level selection signal SEL1 and the second level not to be deactivated simultaneously. The short detection unit 100 may perform the short detection using the second resistor RS2 after the third point T3.

As the driving unit 400 provides a valid data VALID DATA to the display panel 300, a current flowing through the pixels of the display panel 300 may increase and thus a current flowing through the power lines DV1 and DV2 may increase. The short detection unit 100 may perform the short detection according to the second short detection reference during the second short detection period Tsd2. Here, the short detection enable signal SDEN and the second level selection signal SEL2 are activated during the second short detection period Tsd2, and the second short detection reference is less sensitive to a change of the driving current ISD1 flowing the power lines DV1 and DV2. In this case, the second resistor RS2 used for generating the sensing voltage level VRS in the second short detection period Tsd2 may have a value relatively smaller than that of the first resistor RS1 used for generating the sensing voltage level VRS in the first short detection period Tsd1.

When the short event occurs in the second short detection period Tsd2, the sensing voltage level VRS may become larger than a level of the short detection reference VREF2 at a fourth point T4. In this case, the short detection unit 100 may activate the shut-down control signal CON2 at the fourth point T4, and the DC-DC converter 10 may be deactivated based on the activated shut-down control signal CON2. In example embodiments, the driving unit 400 may provide the short detection reference VREF2 of the DC-DC converter 10 to the short detection unit 100 for activating the short detection reference VREF2.

Figure 11:
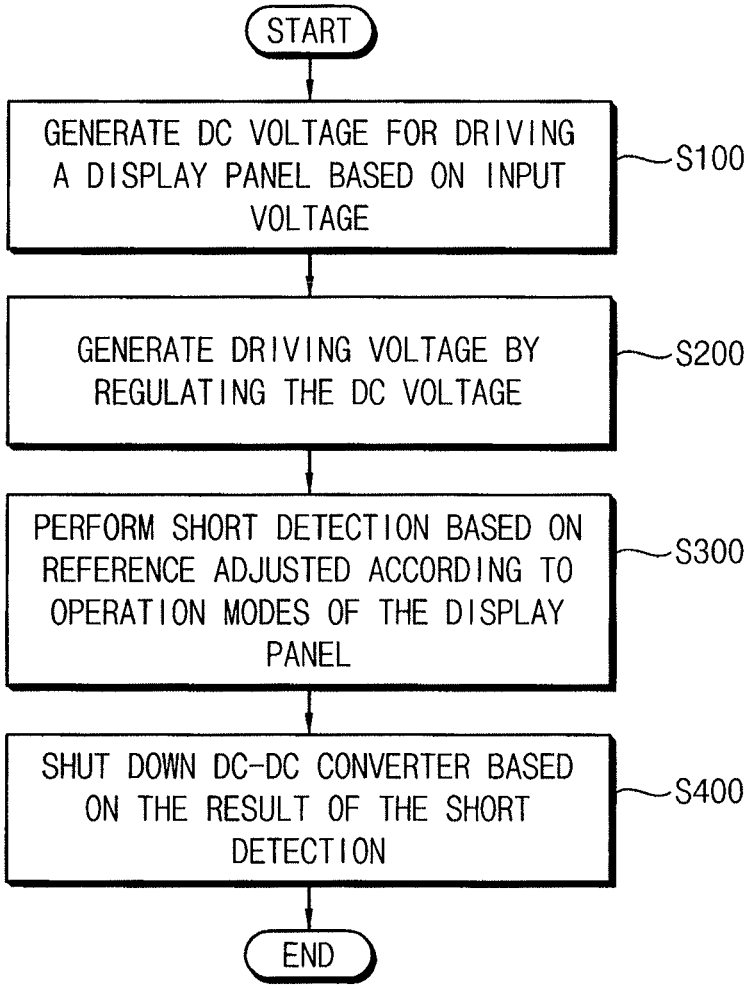
FIG. 11 is a flow chart illustrating a method of controlling a driving voltage for a display panel in accordance with example embodiments.

FIG. 11 is a flow chart illustrating a method of controlling a driving voltage for a display panel in accordance with example embodiments.

Referring to FIGS. 1, 7 and 11, in the method of controlling a driving voltage for a display panel in accordance with example embodiments, the DC-DC converter 10 may generate the DC voltage VM for driving the display panel 300 based on an input voltage in step S100, may generate the driving voltages DV1 and DV2 by regulating the DC voltage VM in step S200, and may perform a short detection based on a short detection reference determined according to operation modes of the display panel 300 in step S300. The driving unit 400 may shut down the DC-DC converter 10 based on the result of the short detection in step S400.

Since the steps of FIG. 11 may be performed by the DC-DC converter 10 of FIG. 1 and the display device 1000 of FIG. 7, detailed description will be omitted here.

Figure 12:
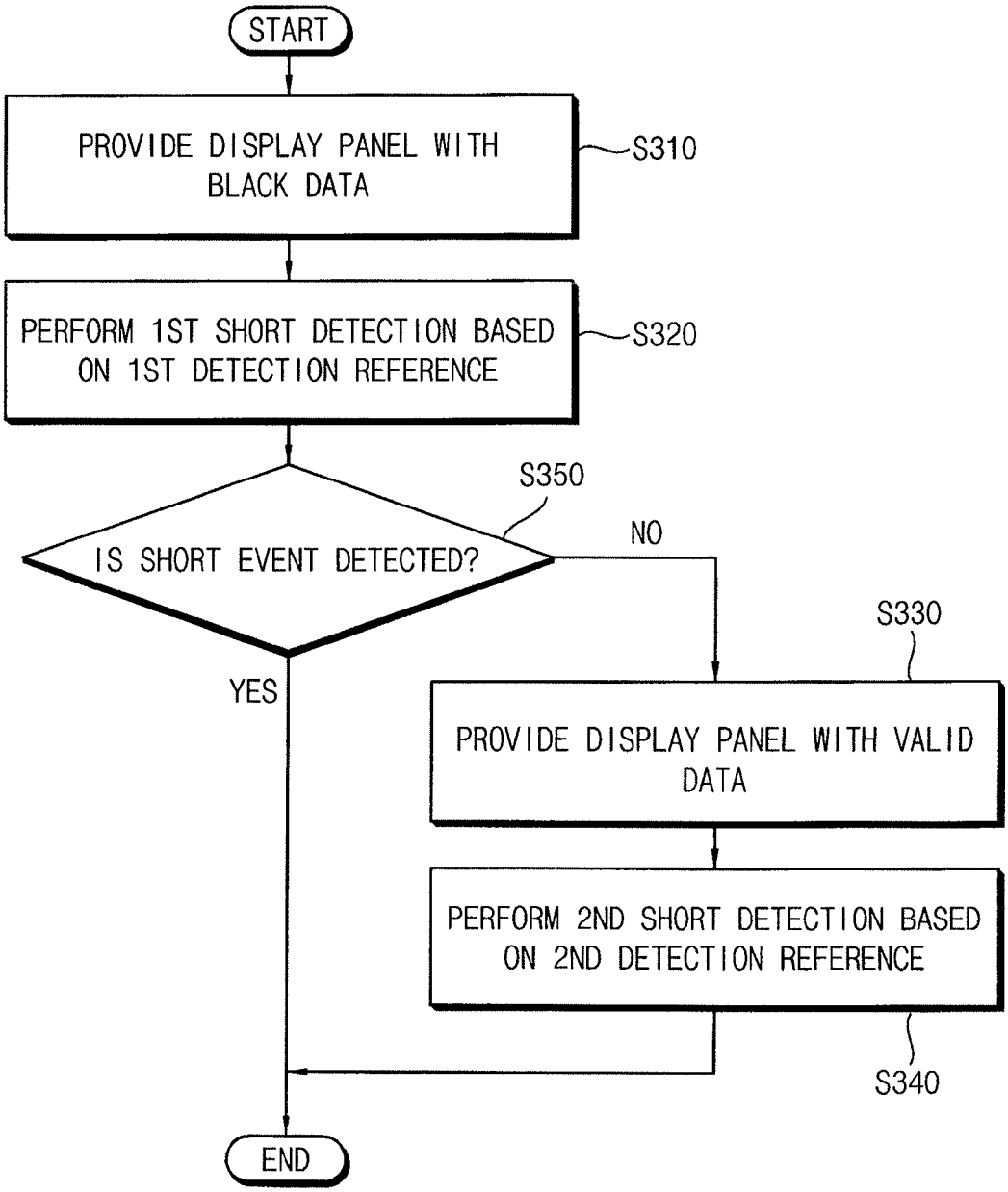
FIG. 12 a flow chart illustrating an example of performing a short detection of FIG. 11.

FIG. 12 a flow chart illustrating an example of performing a short detection of FIG. 11.

Referring to FIGS. 1, 7 and 12, in performing the short detection in step S300, the driving unit 400 may transmit a black data to the display panel 300 in the start-up mode in step S310. The black data may correspond to a black image displayed in the display panel 300. The short detection unit 100 may perform the first short detection by the first short detection reference in the start-up mode in step S320. In this case, the short detection unit 100 may set the short detection reference to the first short detection reference. If a short event is not detected by performing the first short detection (step S350=NO), the driving unit 400 may transmit a valid data in the normal operation mode in step S330. The valid data may correspond to a valid image. The short detection unit 100 may perform the second short detection by the second short detection reference in the normal operation mode in step S340. In this case, the short detection unit 100 may set the short detection reference to the second short detection reference based on the detection control signal CON1. According to example embodiments, the first short detection reference may be for detecting a relatively small short current. Since the first and the second short detection references are fully described above, detailed description will be omitted here.

Since the steps of FIG. 12 may be performed by the DC-DC converter 10 of FIG. 1 and the display device 1000 of FIG. 7, detailed description will be omitted here.

Figure 13:
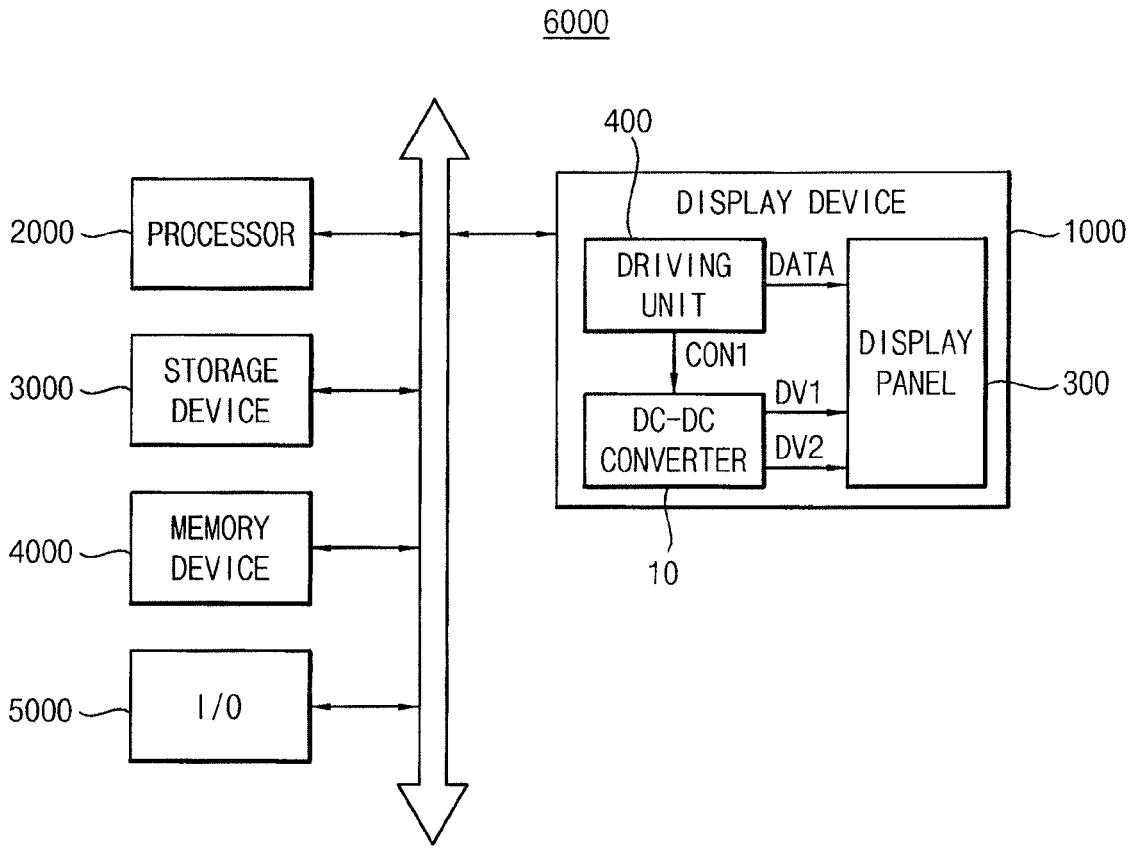
FIG. 13 is a diagram illustrating a display system in accordance with example embodiments.

FIG. 13 is a diagram illustrating a display system in accordance with example embodiments.

Referring to FIG. 13, a system 6000 includes the display device 1000, a processor 2000 and a storage device 3000.

The storage device 3000 stores image data. The storage device 3000 may include a solid state drive (SSD), a hard disk drive (HHD), a CD-ROM, etc.

The display device 1000 displays the image data stored in the storage device 3000. The display device 1000 may include the display panel 300, the DC-DC converter 10 and the driving unit 400. The display panel 300 includes a plurality of pixels each of which operates in response to a first driving voltage DV1, a second driving voltage DV2 and a data signal DATA.

The display device 1000 may include all kinds of a display device in so far as the display panel 300 displays an image using at least two driving voltages DV1 and DV2 received from the DC-DC converter 10. For example, the display device 1000 may include an organic light emitting display device. In this case, each of the plurality of pixels included in the display panel 300 includes an organic light emitting diode (OLED).

The display device 1000 may have the same structure as the display device 1000 of FIG. 7. A structure and an operation of the display device 1000 of FIG. 7 are described above with reference to FIGS. 1 to 11. Thus, a detailed description of the display device 1000 included in the system 6000 will be omitted.

The processor 2000 controls the storage device 3000 and the display device 1000. The processor 2000 may perform specific calculations, or computing functions for various tasks. For example, the processor 2000 may include a microprocessor, a central processing unit (CPU), etc. The processor 2000 may be coupled to the storage device 3000 and the display device 1000 via an address bus, a control bus, and/or a data bus. In addition, the processor 2000 may be coupled to an extended bus such as a peripheral component interconnection (PCI) bus.

The system may further include a memory device 4000 and an I/O device 5000. In some example embodiments, the system 6000 may further include a plurality of ports (not illustrated) that communicate with a video card, a sound card, a memory card, a universal serial bus (USB) device, other electric devices, etc.

The memory device 4000 may store data for operations of the system 6000. For example, the memory device 4000 may include at least one volatile memory device such as a dynamic random access memory (DRAM) device, a static random access memory (SRAM) device, etc. and/or at least one non-volatile memory device such as an erasable programmable read-only memory (EPROM) device, an electrically erasable programmable read-only memory (EEPROM) device, a flash memory device, etc.

The I/O device 5000 may include at least one input device (e.g., a keyboard, keypad, a mouse, etc.), and/or at least one output device (e.g., a printer, a speaker, etc.). In some example embodiments, the display device 1000 may be included in the I/O device 5000.

The system 6000 may comprise any of several types of electronic devices, such as a digital television, a cellular phone, a smart phone, a personal digital assistant (PDA), a personal media player (PMP), a portable game console, a computer monitor, a digital camera, a MP3 player, etc.

The DC-DC converter 10 of FIG. 13 may be realized using the DC-DC converter 10 of FIG. 1. Since a structure and an operation of the DC-DC converter 10 of FIG. 13 are substantially the same as those of the DC-DC converter 10 of FIG. 1, a detailed description will be omitted.

By way of summation and review, each pixel of a plurality of pixels included in an organic light emitting display has an organic light emitting diode (OLED). The OLED generates light by coupling holes and electrons in an organic material layer formed between an anode and a cathode. Electrons are provided from the cathode to which a negative driving voltage (ELVSS) is applied. Holes are provided from the anode to which a positive driving voltage (ELVDD) is applied. To apply the positive driving voltage and the negative driving voltage to the OLED, a wiring for the positive driving voltage and a wiring for the negative driving voltage are formed to overlap each other on the display panel.

If the wiring for the positive driving voltage and the wiring for the negative driving voltage are shorted together, i.e., by a crack on the display panel and/or a foreign substance in the display panel, a heating problem and/or a fire may result. Thus, there is a need for detecting a short current flowing through the wiring to prevent heating and/or damage to the display panel.

A display device may be operated in various operation modes. Since power consumed by pixels varies according to the operation mode, a range of current flowing through wirings for providing driving voltages to a display panel also varies. Thus, it is difficult to detect a short in a display panel.

Example embodiments are directed to a DC-DC converter that detects whether a display panel is shorted based on a short detection reference that is adjusted according to an operation mode of the display panel. Example embodiments are also directed to a method of controlling driving voltages for detecting whether the display panel is shorted based on the short detection reference that is adjusted according to the operation mode of the display panel.

Exemplary embodiments have been disclosed herein, and although specific terms are employed, they are used and are to be interpreted in a generic and descriptive sense only and not for purpose of limitation.

What is claimed is:

1. A DC-DC converter, comprising:

a voltage conversion unit to generate a DC voltage for driving a display panel based on an input voltage; and a short detection unit, the short detection unit to generate a driving voltage based on the DC voltage, to output the driving voltage through a power line, and to perform a short detection to detect whether the display panel is shorted based on a selection signal and a short detection reference that are adjusted according to an operation mode of the display panel, wherein the short detection unit includes a short detection block, the short detection block to generate a sensing current that is proportional to a current flowing through the power line, to generate a sensing voltage based on the sensing current and the selection signal related to the operation mode, and to determine, based on a level of the sensing voltage, whether a short current flows through the power line, wherein the sensing current flows through a same sensing current line regardless of the operation mode of the display panel.

2. The DC-DC converter as claimed in claim 1, wherein the short detection unit further includes a voltage output block to stabilize the DC voltage to generate the driving voltage.

3. The DC-DC converter as claimed in claim 2, wherein the voltage output block includes:

an input block to transmit an output voltage of the voltage conversion unit to the power line based on a control voltage;

a voltage division block to divide the driving voltage by a division ratio, the voltage division block being to output a divided driving voltage; and an error amplification block to generate the control voltage by comparing a level of the divided driving voltage with a level of an amp reference voltage, the error amplification block applying the control voltage to the input block.

4. The DC-DC converter as claimed in claim 2, wherein the short detection block includes:

a current sensing block to generate the sensing current proportional to the current flowing through the power line;

a level selection block to generate the sensing voltage based on the selection signal, the sensing voltage corresponding to the sensing current and having different detection sensitivities according to the operation mode; and a comparison block to generate a short detection signal by comparing the level of the sensing voltage with a level of a reference voltage.

5. The DC-DC converter as claimed in claim 4, wherein the current sensing block includes a sensing transistor that forms a current mirror with a pass transistor of the voltage output block, the voltage output block performing a linear low-dropout voltage regulation using the pass transistor, and wherein the sensing current flows through the sensing transistor and the level selection block, the sensing current being proportional to the current flowing through the power line coupled to the pass transistor.

6. The DC-DC converter as claimed in claim 4, wherein the level selection block includes:

a plurality of switches to be selectively turned on in response to the selection signal; and a plurality of resistors respectively coupled to the plurality of switches in series, and wherein, when the switches are turned on, the sensing voltage is generated by the sensing current flowing through at least one of the plurality of resistors coupled to the switches.

7. The DC-DC converter as claimed in claim 6, wherein the level selection block has a controlled impedance, the controlled impedance being controlled by the selection signal, and the level selection block is to generate the sensing voltage based on the controlled impedance.

8. The DC-DC converter as claimed in claim 1, wherein the short detection unit includes at least one low-dropout regulator to output the driving voltage for driving the display panel to the power line.

9. The DC-DC converter as claimed in claim 1, wherein:

the operation mode of the display panel includes a start-up mode and a normal operation mode, the short detection reference is adjusted to a first value in the start-up mode and is adjusted to a second value lower than the first value in the normal operation mode, and the short detection unit performs the short detection based on the short detection reference of the first value when the display panel is in the start-up mode and performs the short detection based on the short detection reference of the second value when the display panel is in the normal operation mode.

10. The DC-DC converter as claimed in claim 9, wherein black data is applied to the display panel as display data in the start-up mode, and valid image data is applied to the display panel as display data in the normal operation mode.

11. The DC-DC converter as claimed in claim 1, wherein the short detection unit generates a shut-down control signal based on a result of the short detection, and the voltage conversion unit is shut down based on the shut-down control signal.

12. The DC-DC converter as claimed in claim 1, wherein the short detection reference has different detection thresholds according to the operation mode of the display panel.

13. The DC-DC converter as claimed in claim 1, wherein the short detection unit performs the short detection based on the short detection reference when a detection enable signal is activated.

14. The DC-DC converter as claimed in claim 1, wherein the short detection unit performs the short detection by comparing a level of a sensing voltage with a level of a reference voltage, the level of the sensing voltage being determined based on the selection signal and a magnitude of a short current flowing through the power line.

15. The DC-DC converter as claimed in claim 14, wherein the level of the reference voltage is set by an external control signal, or programmed as a predetermined value by cutting a fuse.

16. The DC-DC converter as claimed in claim 1, wherein:

the display panel includes an organic light emitting display panel, and the driving voltage generated by the short detection unit includes a positive driving voltage and a negative driving voltage for driving the organic light emitting display panel.

17. The DC-DC converter as claimed in claim 1, wherein the short detection unit is single, and performs selectively in one of at least two of different detection modes based on the selection signal.

18. A display device, comprising:

a display panel including a plurality of pixels that operate based on a first driving voltage, a second driving voltage, and a data signal;

a driving unit to provide the data signal to the display panel; and a DC-DC converter to output the first driving voltage and the second driving voltage through a power line to detect whether the display panel is shorted based on a short detection reference that is adjusted according to an operation mode of the display panel to shut down based on a result of the detection, and the DC-DC converter including:

a voltage conversion unit to generate a first DC voltage and a second DC voltage for driving the display panel based on an input voltage; and a short detection unit to adjust the short detection reference and a selection signal according to the operation mode of the display panel and to detect whether the display panel is shorted based on the adjusted selection signal and short detection reference, wherein the short detection unit includes a short detection block, the short detection block to generate a sensing current that is proportional to a current flowing through the power line, to generate a sensing voltage based on the sensing current and the adjusted selection signal related to the operation mode, and to determine, based on a level of the sensing voltage, whether a short current flows through the power line, wherein the sensing current flows through a same sensing current line regardless of the operation mode of the display panel.

19. The display device as claimed in claim 18, wherein:

the driving unit provides black data to the display panel in a start-up mode, the black data corresponding to a black image, and the driving unit provides valid data to the display panel in a normal operation mode, the valid data corresponding to a valid image, in the start-up mode, the short detection unit sets the short detection reference to a first short detection reference based on the detection control signal, and the short detecting unit performs a first short detection using the first short detection reference, and in the normal operation mode, the short detection unit sets the short detection reference to a second short detection reference based on the detection control signal, and the short detecting unit performs a second short detection using the second short detection reference.

20. A method of controlling a driving voltage, comprising:

generating a DC voltage for driving a display panel based on an input voltage;

generating a driving voltage based on the DC voltage;

performing a short detection to detect whether the display panel is shorted based on a selection signal and a short detection reference that are adjusted according to an operation mode of the display panel; and shutting down a DC-DC converter that generates the driving voltage based on a result of the short detection, wherein performing the short detection includes:

generating a sensing current that is proportional to a current flowing through a power line;

generating a sensing voltage based on the sensing current and the selection signal related to the operation mode; and determining, based on a level of the sensing voltage, whether a short current flows through the power line, wherein the sensing current flows through a same sensing current line regardless of the operation mode of the display panel.

21. The method as claimed in claim 20, wherein performing the short detection further includes:

providing black data to the display panel in a start-up mode, the black data corresponding to a black image;

setting the short detection reference to a first short detection reference based on a detection control signal in the start-up mode;

performing a first short detection based on the first short detection reference in the start-up mode;

providing valid data to the display panel in a normal operation mode if a short event is not detected during the start-up mode, the valid data corresponding to a valid image;

setting the short detection reference to a second short detection reference based on the detection control signal in the normal operation mode; and performing a second short detection based on the second short detection reference in the normal operation mode.

* * * * *